US005886610A

United States Patent [19]

Canova

[11] Patent Number: 5,886,610

[45] Date of Patent: Mar. 23, 1999

[54] ULTRA FLAT MAGNETIC DEVICE FOR ELECTRONIC CIRCUITS

[76] Inventor: Antonio Canova, Via Po No. 79/A, Montevarchi, Arezzo, Italy

[21] Appl. No.: 888,750

[22] Filed: Jul. 7, 1997

[51] Int. Cl.[6] ..... H01F 27/02; H01F 27/28

[52] U.S. Cl. ..... 336/83; 336/183; 336/232; 336/200

[58] Field of Search ..... 336/83, 183, 96, 336/223, 234, 232

[56] References Cited

U.S. PATENT DOCUMENTS

| | | | |
|---|---|---|---|
| 5,010,314 | 4/1991 | Estrov | 336/198 |
| 5,175,525 | 12/1992 | Smith | 336/83 |
| 5,345,679 | 9/1994 | Pitzele et al. | 336/223 |
| 5,684,445 | 11/1997 | Kobayashi et al. | 336/83 |

FOREIGN PATENT DOCUMENTS

| | | | |
|---|---|---|---|
| 0 435 461 B1 | 1/1985 | European Pat. Off. . | |
| 0 293 617 A1 | 7/1988 | European Pat. Off. . | |
| 602838A1 | 6/1994 | European Pat. Off. | 336/232 |
| 0 671 749 A1 | 8/1995 | European Pat. Off. . | |
| 0 671 749 A1 | 3/1994 | Germany . | |
| 195 05 463 A1 | 8/1995 | Germany . | |

*Primary Examiner*—Michael L. Gellner
*Assistant Examiner*—Anh Mai
*Attorney, Agent, or Firm*—Waddey & Patterson; Mark J. Patterson

[57] ABSTRACT

The low-profile magnetic device comprises at least one winding formed by a plurality of conductive metal laminations (9) of substantially annular layout, superposed and electrically insulated from each other and with respect to the ferromagnetic core and furnished with appendages (9X) for external connection. The laminations are accommodated in a well (7A) produced in an electrically insulating container (7) inserted into the said ferromagnetic core (1A, 1B) and a sheet of insulating material (11) is disposed between adjacent laminations. Each of the said laminations (9) is furnished, along at least one of its edges, with a plurality of protuberances (9A, 9B, 9C) disposed in such a way that on mutually superposing identical laminations rotated by 180° one with respect to another about a mid-line (M—M) lying in the plane of the lamination, the protuberances of one lamination (9) are angularly offset with respect to the protuberances of the adjacent laminations.

21 Claims, 3 Drawing Sheets

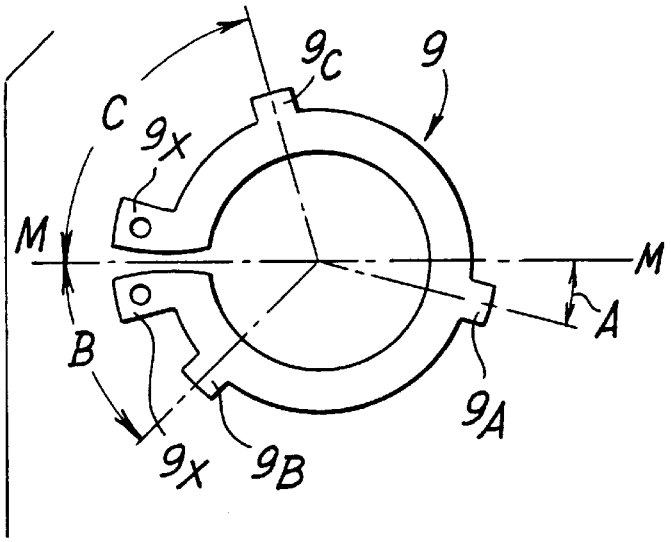
Fig. 3
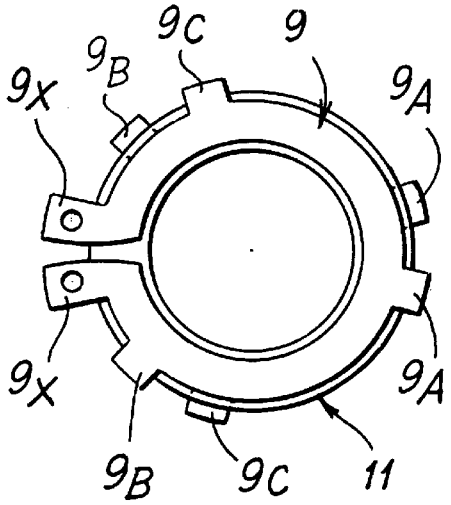
Fig. 2
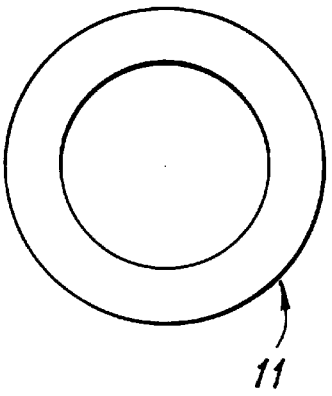
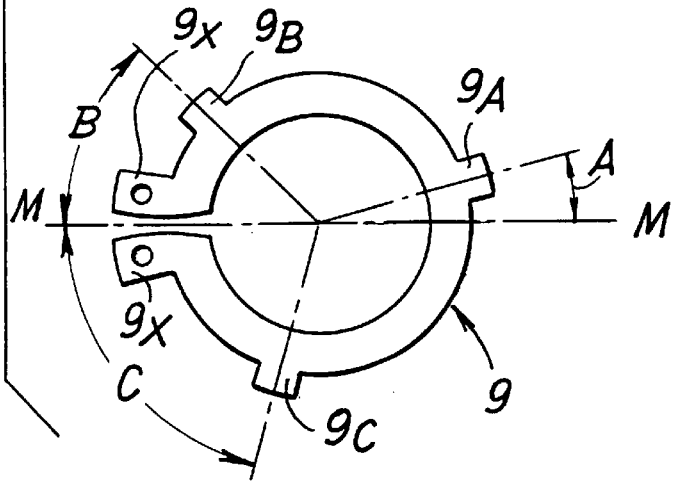

ULTRA FLAT MAGNETIC DEVICE FOR ELECTRONIC CIRCUITS

TECHNICAL FIELD

The present invention relates to a magnetic component or device of limited thickness (so-called low-profile) with a ferromagnetic core with a housing for at least one winding, comprising at least one winding formed by a plurality of mutually superposed conductive metal laminations electrically insulated from each other and with respect to the ferromagnetic core.

BACKGROUND ART

In many applications in the electronics sector, for example in the construction of DC/DC converters, it becomes necessary to produce power transformers of limited thickness. These components present appreciable constructional difficulties since they are required to have very small dimensions, this being achieved with extremely costly structures which are complex to produce. A particular problem is represented by the mutual insulation between turns of the winding and between turns and ferromagnetic core. There are currently various constructional techniques for producing this type of component, based on the use of turns formed by copper conductive laminations suitably varnished to guarantee mutual insulation and insulation with respect to the ferromagnetic core. The application of insulating varnish is a lengthy and complex operation since appropriate insulation requires the application of many coats of varnish. Other techniques provide for the production of wire coils suitably encapsulated so as to be insulated from the ferromagnetic core.

It is also difficult, in ultra-flat transformers, to achieve high copper densities, that is to say a high quantity of copper for equal volume. The high density is necessary for transferring high power.

Examples of ultra-flat transformers obtained by various techniques are described in, amongst other documents, U.S. Pat. No. 5,175,525, U.S. Pat. No. 5,010,314, EP-B-O 435 461.

Problems similar to those of transformers arise in the production of inductive components for electronic circuits. In this case also, it becomes necessary in certain cases to produce low-profile or ultra-flat components.

OBJECTS OF THE INVENTION

An object of the present invention is the production of a magnetic component of the type mentioned initially, and which is easier and more economical to make.

In particular, the object of the present invention is the production of a magnetic component in which the insulation between turns of the winding and ferromagnetic core and between adjacent turns can be obtained in a reliable and low-cost manner.

Yet a further object of the present invention is the production of an ultra-flat magnetic component with high density of copper.

A further object of the invention is the production of a structure which does not require very tight manufacturing tolerances and which allows easy assembly.

SUMMARY OF THE INVENTION

These and further objects and advantages, which will become clear to those skilled in the art from reading the following text, are achieved according to the invention by making provision to accommodate the electrically conductive laminations in a well produced in an electrically insulating container inserted into the said ferromagnetic core and by disposing a sheet of insulating material between adjacent laminations. The insulating sheets prevent electrical contact between the adjacent laminations, while the container insulates the laminations from the ferromagnetic core. Moreover, each of the said laminations is furnished, along at least one of its edges, with a plurality of protuberances disposed in such a way that on mutually superposing identical laminations rotated by 180° one with respect to another about a mid-line lying in the plane of the lamination, the protuberances of one lamination are angularly offset with respect to the protuberances of the adjacent laminations.

As will become clear subsequently, the presence of the protuberances enables the individual laminations to be fitted easily, with a self-centring effect, into the container. Moreover, the sheet of insulating material need not be cut with extreme precision, it being sufficient for its edge to come within the tolerance defined by the difference between the dimension of the edge of the lamination and the dimension of the protuberances with which the said edge is furnished. Since the disposition is such as to prevent contact between protuberances of adjacent laminations, electrical insulation is still guaranteed between each lamination and the succeeding lamination.

The laminations have an external annular edge and an internal annular edge, preferably concentric the one with respect to the other. The protuberances can be provided on one, on the other or on both edges; by way of exemplification, in the example illustrated subsequently they are disposed on the external edge. The laminations can have a circular ring layout but this is not strictly necessary, it being possible to adopt different forms, for example polygonal, elliptical or other. In the description which follows and in the claims unless stated otherwise the term annular is to be understood in the broad sense and encompasses any of the aforesaid shapes or equivalent shapes.

In a particularly advantageous embodiment, the insulating container has a circular ring section, with an internal wall in contact with a wall of a central portion of the ferromagnetic core, and an external wall in contact with a wall of the ferromagnetic core, concentric with the wall of the said central portion.

According to one possible embodiment, the protuberances provided on each lamination are three, the minimum number to guarantee correct centring of the laminations in the well defined by the insulating container. These protuberances can be disposed, with respect to a pair of appendages for electrical connection with which the laminations are furnished, with an angular distance of around 45°, around 165° and around 285°.

The structure according to the present invention can be adopted in order to produce magnetic components of varied type, for example inductors with a single winding, or components with several magnetically coupled windings and hence in particular for the production of transformers.

The structure according to the invention is particularly advantageous, in that it makes it possible to carry out insulation tests before finalized fitting of the ferrite core. In this way it is possible to make corrections and adjustments in the event of defective fitting, without having to scrap the entire component as happens with conventional systems.

The invention also relates individually to an annular lamination of electrically conductive material for the production of a magnetic device, comprising means for electrical connection, characterized by a plurality of protuberances disposed along at least one of the edges, positioned in such a way that on mutually superposing identical laminations rotated by 180° one with respect to another about a mid-line lying in the plane of the lamination, the protuberances of one lamination are angularly offset with respect to the protuberances of the adjacent laminations.

Further advantageous characteristics of the device and of the lamination according to the invention are indicated in the dependent claims attached.

BRIEF DESCRIPTION OF THE DRAWINGS

The invention will be better understood in accordance with the description and the appended drawing, which shows a practical non-limiting exemplification of the invention. In e drawing:

FIG. 2 shows three elements making up the winding in the situation preceding fitting;

FIG. 3 shows the mutual position of the three elements of FIG. 2 in the superposed situation, in which they will be inserted into the device;

DETAILED DESCRIPTION OF THE INVENTION

Figure 1:
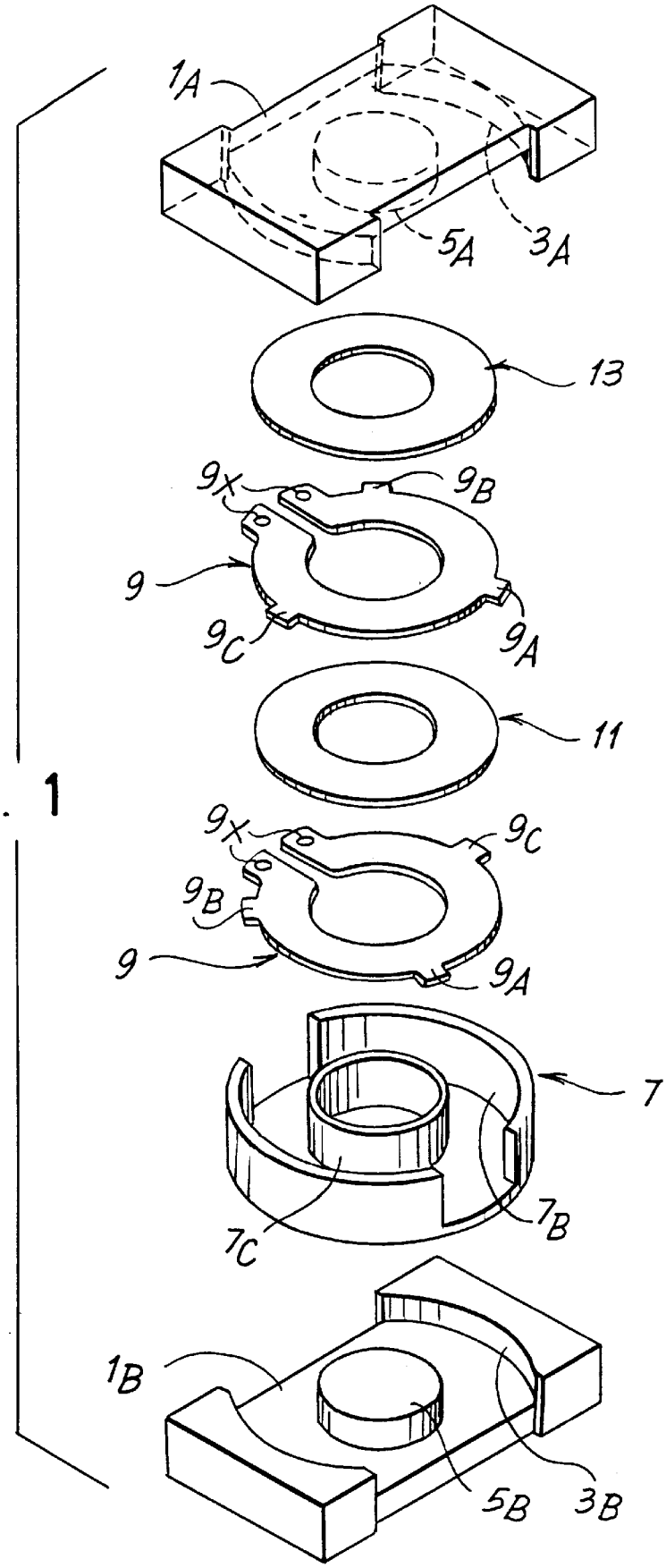
FIG. 1 shows an exploded view of a component according to the invention.
Figure 4:
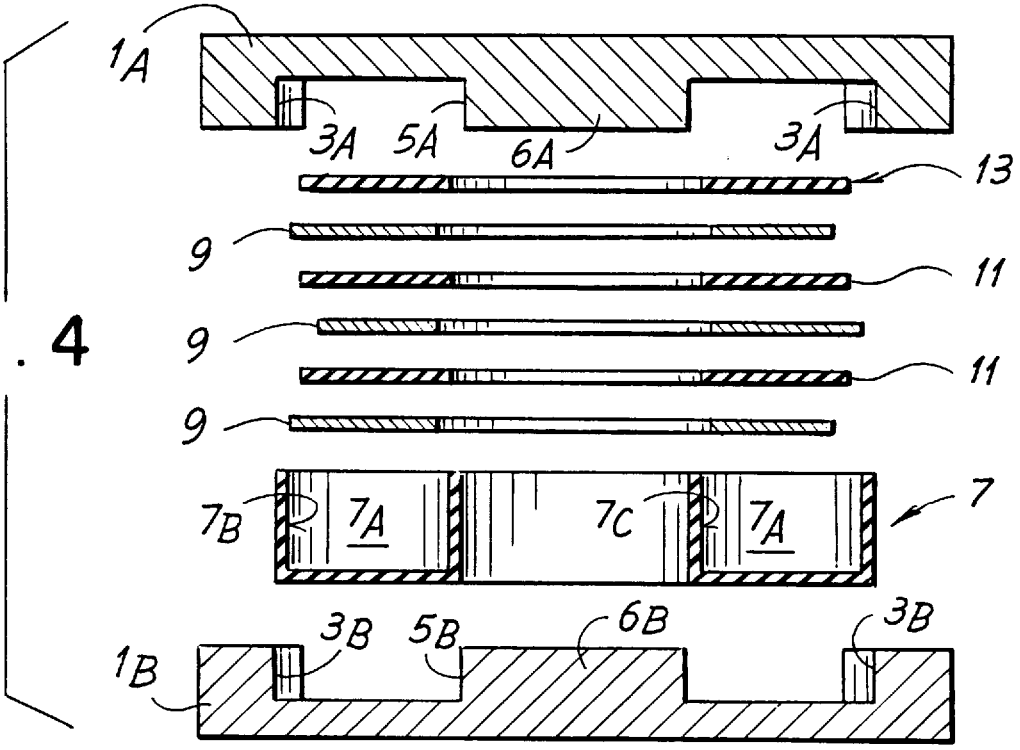
FIG. 4 shows an axial section of the component in the exploded situation.

The structure of the component according to the invention comprises a ferromagnetic core (for example made of ferrite) which, in the example of the drawing, is made up of two substantially identical parts indicated 1A and 1B. Each of the two portions 1A, 1B has a housing defined by two external cylindrical walls 3A, 3B and by an internal cylindrical wall 5A, 5B concentric with the external walls 3A, 3B and defining a central portion 6A, 6B of the ferromagnetic core 1A, 1B. When the two portions 1A, 1B are coupled together, the cylindrical walls 3A, 3B, 5A, 5B define a housing for a container 7 of insulating material, which defines an internal well 7A in which are disposed the turns of one or more electrical windings described subsequently. The container 7 has two concentric circular walls 7B, 7C which in the fitted situation are in contact with the cylindrical walls 3A, 3B, 5A, 5B of the core 1A, 1B.

Conductive turns each formed from a sheared lamination 9 made from a conductive material, especially copper, are disposed inside the container 7. A sheet of suitable insulating material 11 is disposed between two adjacent laminations 9. The laminations 9 and also the sheets of insulating material 11 have a central hole with a diameter substantially corresponding to the diameter of the cylindrical wall 7C of the container 7, the internal diameter of the insulating sheet being slightly less than the internal diameter of the laminations, so as to guarantee insulation between the adjacent laminations 9. The laminations 9 and the insulating sheets 11 are sufficient in number to fill up the volume of the container 7, and an insulating closure sheet, indicated 13, is disposed above the pack formed by these elements.

Each lamination 9 consists of an open annulus, with two appendages 9X which allow electrical connection of the laminations to the power supply and to each other, according to a technique known per se and described for example in EP-B-O 435 461, the contents of which are incorporated into the present description.

Moreover, each lamination 9 has a plurality of radial protuberances or teeth. In the example of the drawing three teeth are provided on the external edge of each lamination, indicated 9A, 9B, 9C. The protuberances 9A, 9B, 9C can project, with respect to the external edge of the lamination 9, by around 1/10–1/20 of the diametral dimension of the lamination.

As may be seen in particular in FIG. 2, the protuberances 9A, 9B, 9C are disposed with angles A, B and C with respect to the middle line M—M lying in the plane of the lamination 9. The angles A, B and C are chosen in such a way that on mutually superposing two laminations 9 rotated by 180° one with respect to another about the line M—M, the protuberances 9A, 9B, 9C of one lamination are angularly offset with respect to all the protuberances of the overlying lamination, as can be seen in FIGS. 2 and 3: shown in FIG. 2 are two laminations 9 next to each other rotated by 180° about the middle line M—M, while shown in FIG. 3 are the same two laminations mutually superposed with the interposition of the insulating sheet 11. In particular, the angle A can be around 15°, the angle B around 45° and the angle C around 75°.

The diameter of the circumference on which the external edges of the protuberances 9A, 9B, 9C lie corresponds to the diameter of the cylindrical wall 7B of the container 7, so that the individual laminations 9 are centred in the container 7. The diameter of the external circular profile of the laminations 9, excluding the protuberances 9A, 9B, 9C, is slightly less than the external diameter of the sheet 11. In this way, without the need to produce a sheet 11 within particularly tight tolerances, it is possible to insulate the individual superposed laminations 9 effectively one with respect to another.

As is clear from FIG. 3, the disposition of the protuberances is such that mutual contact between protuberances 9A, 9B, 9C of two laminations 9 rotated by 180° and superposed is prevented even if the laminations are superposed with an angular stagger in the plane in which they lie, that is to say with the appendages 9X mutually offset rather than coincident. This enables the functionality of the device to be maintained even when disposing the appendages 9X in such a way that they can be connected to more than two external contacts.

Figure 5:
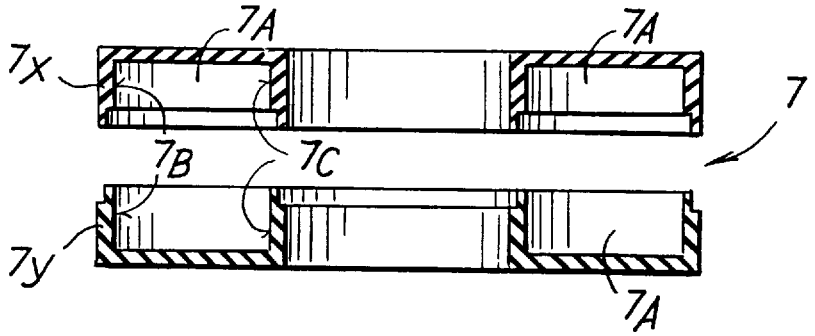
FIG. 5 shows an axial section of a modified embodiment of the insulating container of the annular laminations.

The container 7 can also be produced in two substantially symmetrical parts, as shown in FIG. 5, where the two parts are labelled with the references 7X and 7Y. The two mating edges of the two portions advantageously have means of mutual engagement. In this case, the insulating closure sheet 13 is not required.

The container 7 can be produced in a material which is sufficiently temperature-resistant (up to around 200° C.), in which case it can be used as a support for the connections between windings and between laminations.

Figure 6:
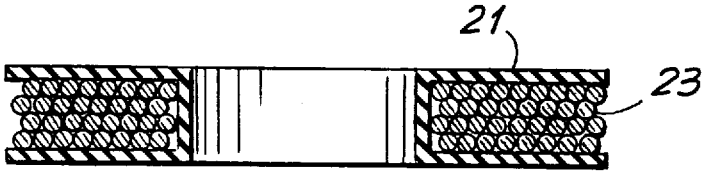
FIG. 6 shows a winding which can be used as an alternative to or in combination with the winding shown in FIG. 4.

For a few particular applications, a reel 21 made of insulating material and on which a conductor wire 23 (FIG. 6) is wound, can be accommodated, in addition to the container 7 or as an alternative thereto, in the ferrite core 1A, 1B.

It should be understood that the drawing shows merely an exemplification given solely as a practical demonstration of the invention, it being possible for this invention to vary in its forms and provisions without however departing from the scope of the concept underlying the invention. The possible presence of reference numbers in the attached claims has the object of facilitating the reading of the claims with reference to the description and to the drawing, and does not limit the scope of the protection represented by the claims.

I claim:

1. Low-profile magnetic device, with a ferromagnetic core (1A, 1B) with a housing for a conductor winding, comprising at least one winding formed by a plurality of conductive metal laminations (9) of substantially annular layout, superposed and electrically insulated from each other and with respect to the ferromagnetic core and furnished with appendages (9X) for external connection, characterized in that:

the said laminations are accommodated in a well (7A) produced in an electrically insulating container (7) inserted into the said ferromagnetic core (1A, 1B);

a sheet of insulating material (11) is disposed between adjacent laminations;

each of the said laminations (9) is furnished, along at least one of its edges, with a plurality of protuberances (9A, 9B, 9C) disposed in such a way that on mutually superposing identical laminations rotated by 180° one with respect to another about a mid-line (M—M) lying in the plane of the lamination, the protuberances of one of one lamination (9) are angularly offset with respect to the protuberances of the adjacent laminations.

2. Device according to claim 1, characterized in that the said protuberances (9A, 9B, 9C) are disposed in such a way that they are offset even when two mutually identical laminations rotated by 180° about the said mid-line (M—M) and superposed are angularly offset by mutual rotation in the plane in which they lie.

3. Device according to claim 1, characterized in that the said laminations (9) have an internal annular edge and an external annular edge and that the said protuberances (9A, 9B, 9C) are disposed on the external annular edge.

4. Device according to claim 3, characterized in that the said sheet of insulating material (11) has a substantially annular layout, with an internal annular edge and an external annular edge and that the external dimension of the said sheet of insulating material is included between the dimension of the external annular edge of the said laminations (9) and the external dimension of the said protuberances (9A, 9B, 9C).

5. Device according to claim 1, characterized in that the said laminations (9) have an internal annular edge and an external annular edge and that the said protuberances (9A, 9B, 9C) are disposed on the internal annular edge.

6. Device according to claim 5, characterized in that the said sheet of insulating material (11) has a substantially annular layout, with an internal annular edge and an external annular edge and that the internal dimension of the said sheet of insulating material is included between the dimension of the internal annular edge of the said laminations (9) and the internal dimension of the said protuberances (9A, 9B, 9C).

7. Device according to claim 1, characterized in that the said insulating container (7) has an annular cross-section, with an internal wall (7C) in contact with a wall (5A, 5B) of a central portion (6A, 6B) of the ferromagnetic core (1A, 1B) and an external wall (7B) in contact with a wall (3A, 3B) of the ferromagnetic core, concentric with the wall (5A, 5B) of the said central portion (6A, 6B).

8. Device according to claim 1, characterized in that the surfaces of the said laminations (9) are devoid of insulating varnish.

9. Device according to claim 1, characterized in that each lamination has three protuberances (9A, 9B, 9C).

10. Device according to claim 9, characterized in that the said appendages (9X) are next to each other.

11. Device according to claim 1, characterized in that each lamination (9) has two appendages (9X) for external electrical connection.

12. Device according to claims 8 or 11, characterized in that the said protuberances (9A, 9B, 9C) are disposed, with respect to the said appendages (9X), with an angular distance of around 45°, around 165° and around 285°.

13. Device according to claim 1, characterized in that the said laminations (9) are connected together to form a single winding.

14. Device according to claim 1, characterized in that it comprises two or more windings which are coupled together magnetically via the said ferromagnetic core (1A, 1B).

15. Device according to claim 14, characterized in that the said two or more windings are made from the said laminations (9).

16. Device according to claim 14, characterized in that one of the said windings is made from a wire (23) wound in an insulating reel (21) accommodated in the said ferromagnetic core (1A, 1B).

17. Annular lamination according to claim 16, characterized in that the said protuberances are disposed on the external edge.

18. Annular lamination of electrically conductive material for the production of a magnetic device, comprising means (9X) for electrical connection, characterized by a plurality of protuberances (9A, 9B, 9C) disposed along at least one of the edges, positioned in such a way that on mutually superposing identical laminations (9) rotated by 180° one with respect to another about a mid-line (M—M) lying in the plane of the lamination, the protuberances of one lamination (9) are angularly offset with respect to the protuberances of the adjacent laminations.

19. Annular lamination according to claim 18, characterized in that the said protuberances (9A, 9B, 9C) are disposed in such a way that they are offset even when two mutually identical laminations rotated by 180° about the said mid-line (M—M) and superposed are angularly offset by mutual rotation in the plane in which they lie.

20. Annular lamination according to claim 18 or 19, characterized in that it comprises three protuberances (9A, 9B, 9C).

21. Annular lamination according to claim 20, characterized in that it has a pair of appendages (9X) next to each other for electrical connection, and that the said three appendages are disposed, with respect to the said appendages (9X), with an angular distance of around 45°, around 165° and around 285° respectively.

* * * * *